US007702268B2

(12) United States Patent
Suzuki

(10) Patent No.: US 7,702,268 B2
(45) Date of Patent: Apr. 20, 2010

(54) COLOR IMAGE FORMING APPARATUS

(75) Inventor: Shinya Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 915 days.

(21) Appl. No.: 11/442,341

(22) Filed: May 30, 2006

(65) Prior Publication Data

US 2006/0275057 A1 Dec. 7, 2006

(30) Foreign Application Priority Data

Jun. 6, 2005 (JP) ..... 2005-165453

(51) Int. Cl.
*G03G 15/01* (2006.01)

(52) U.S. Cl. ..... 399/301; 347/116

(58) Field of Classification Search ..... 399/301; 347/116

See application file for complete search history.

(56) References Cited

U.S. PATENT DOCUMENTS

| | | | | |
|---|---|---|---|---|
| 4,841,336 | A | 6/1989 | Kusumoto et al. | |
| 4,933,727 | A * | 6/1990 | Mizuma et al. | 399/301 |
| 4,937,664 | A | 6/1990 | Chiku et al. | 358/75 |

FOREIGN PATENT DOCUMENTS

| | | |
|---|---|---|
| JP | 7-234612 | 9/1995 |
| JP | 2633877 | 4/1997 |
| JP | 11-327254 | 11/1999 |
| JP | 2001-228670 | 8/2001 |
| JP | 3450402 | 1/2003 |

OTHER PUBLICATIONS

Computer-generated partial English-language translation.

* cited by examiner

*Primary Examiner*—David M Gray
*Assistant Examiner*—Ruth N Labombard
(74) *Attorney, Agent, or Firm*—Fitzpatrick, Cella, Harper & Scinto

(57) ABSTRACT

An image forming method includes forming toner images on first and second image bearing members; transferring a first toner image on the first image bearing member and a second toner image on the second image bearing member, in mutually superposed manner, onto a recording material; heating the first and second toner image thereby fixing the same to the recording material; detecting alignment marks on the first and second image bearing members in the course of a continuous job for continuously forming images; controlling relative positions of the first toner image and the second toner image, based on a result of detection of the alignment marks; and increasing a frequency of execution of the relative position control in the continuous job, as the recording material to be subjected to image formation in the continuous job has a smaller width in a direction perpendicular to a transport direction of the recording material.

8 Claims, 14 Drawing Sheets

COLOR IMAGE FORMING APPARATUS

BACKGROUND OF THE INVENTION

1. Field of the Invention

The present invention relates to an image forming method of transferring plural toner images, formed on a plurality of image bearing members, in a superposed manner onto a recording material, and more particularly to an image forming method capable of correcting a relative positional relationship of such toner images on the image bearing members.

2. Related Background Art

In such an image forming apparatus, toner images are formed on first and second image bearing members. Subsequently, the first toner image on the first image bearing member and the second toner image on the second image bearing member are transferred in a superposed manner onto the recording material. Finally, the first and second toner images are heated and fixed on the recording material. In the course of a continuous printing job of executing image formations in a consecutive manner, the relative positional relationship of the first toner image and the second toner image is corrected to reduce an error in the mutually superposed toner images. Such correction of the mutual position is executed, based on a result of detections of alignment marks formed on the first image bearing member and the second image bearing member.

However, in case the image is formed, in a continuous printing job, on a recording sheet having a short width in a direction perpendicular to a transport direction (such direction being hereinafter called a thrust direction), such error cannot be reduced sufficiently. More specifically, in case of forming an image on a recording sheet having a short length in the width direction, a sheet non-passing area is formed on an end portion of the fixing member, and the heat in such a sheet non-passing area is released inside the apparatus, resulting in an elevated temperature in the apparatus and causing a deformation thereof, thus aggravating the error.

SUMMARY OF THE INVENTION

An object of the present invention is to sufficiently suppress an error among the mutually superposed toner image, even in case of forming an image, in a continuous printing job, on a recording sheet having a short length in the thrust direction.

Another object of the present invention is to provide a color image forming apparatus including:

a step of forming toner images on first and second image bearing members;

a step of transferring a first toner image, formed on the first image bearing member, and a second toner image, formed on the second image bearing member, in superposed manner onto a recording material;

a step of heating the first and second toner images thereby fixing the same to the recording material;

a step of detecting alignment marks on the first and second image bearing members transferred to a belt member, in the course of a continuous printing job of continuously forming images;

a step of controlling a relative position of the first toner image and the second toner image, based on a result of detection of the alignment marks; and a step of increasing a frequency of execution of the relative position control in the continuous printing job, as a width of the recording material, subjected to the image formation in the continuous printing job, becomes shorter in a direction perpendicular to a transport direction of the recording material.

DETAILED DESCRIPTION OF THE PREFERRED EMBODIMENTS

In the present invention, a frequency of execution of a relative position control for the toner images is increased as a width of the recording material, subjected to the image formation in the continuous printing job, becomes shorter in a direction perpendicular to a transport direction of the recording material. Such a method enables a control in consideration of a temperature increase by the heat from a sheet non-passing area of a fixing member, thereby sufficiently suppressing a mutual positional error among the toner images.

In the following, an image forming apparatus of the present invention will be explained in detail, with reference to the accompanying drawings.

Embodiment 1

Figure 1:
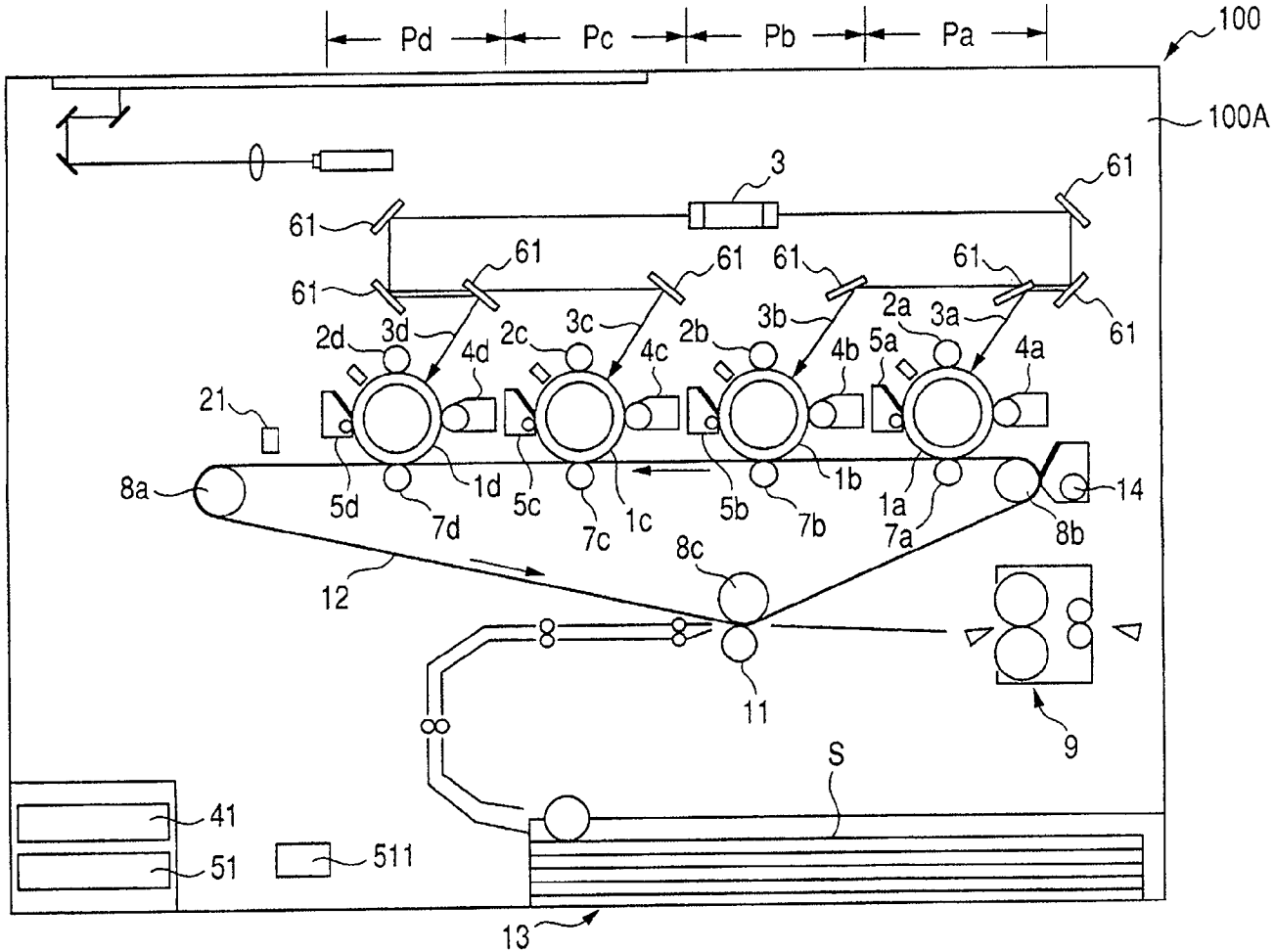
FIG. 1 is a schematic view showing an embodiment of an image forming apparatus of the present invention.

FIG. 1 shows a schematic construction of a color image forming apparatus of tandem type utilizing an intermediate transfer method, constituting an embodiment of the present invention.

In the present embodiment, an image forming apparatus 100 is provided, in a main body 100A thereof, with four image forming parts or image forming stations P (Pa, Pb, Pc, Pd) which are arranged serially along a sheet transport direction. The image forming stations P (Pa, Pb, Pc, Pd) are respectively provided with drum-shaped electrophotographic photosensitive members (image bearing members) or photosensitive drums 1 (1*a*, 1*b*, 1*c*, 1*d*), charging apparatuses 2 (2*a*, 2*b*, 2*c*, 2*d*) formed by charging rollers constituting charging means, an exposure apparatus 3 formed by a laser beam scanner constituting exposure means or an electrostatic latent image forming means, a developing apparatus 4 (4*a*, 4*b*, 4*c*, 4*d*) constituting developing means, a cleaning apparatus 5 (5*a*, 5*b*, 5*c*, 5*d*) including cleaning blades as cleaning means, and primary transfer apparatuses 7 (7*a*, 7*b*, 7*c*, 7*d*) formed by transfer rollers (transfer members) Constituting primary transfer means.

Also an intermediate transfer belt 12, which is a belt-shaped intermediate transfer member, is supported by supporting rollers 8*a*, 8*b* and 8*c* so as to pass between the photosensitive drums 1 (1*a*, 1*b*, 1*c*, 1*d*) and the primary transfer apparatuses 7 (7*a*, 7*b*, 7*c*, 7*d*) of the image forming stations P (Pa, Pb, Pc, Pd) and is thus rendered movable in a direction indicated by an arrow.

In an upper part of the main body 100A of the image forming apparatus, the exposure apparatus 3 is provided and includes an unillustrated light source apparatus and a polygon mirror.

A laser light emitted from the light source apparatus is put into a scanning motion by a rotating polygon mirror, and such laser beam in scanning motion is deflected by a plurality of mirrors 61 and condensed by fθ lenses onto generating lines of the photosensitive drum 1 (1*a*, 1*b*, 1*c*, 1*d*) to form electrostatic latent images thereon, corresponding to image signals. The photosensitive drums 1*a*, 1*b*, 1*c* and 1*d* are respectively exposed by the light beams coming through optical paths 3*a*, 3*b*, 3*c* and 3*d*.

The photosensitive drum 1*a*, constituting the first image bearing member, is charged at a predetermined polarity and a predetermined potential, by the charging roller 2*a* constituting the first charging means. Then, the exposure apparatus 3, constituting the electrostatic latent image forming means, irradiates the photosensitive drum 1*a* in a predetermined position thereof by light passing through the optical path 3*a*, constituting a first optical path, thereby forming a first electrostatic image based on the image signal.

At the same time, the photosensitive drum 1*b*, constituting the second image bearing member, is charged at a predetermined polarity and a predetermined potential, by the charging roller 2*b* constituting the second charging means. Then, the exposure apparatus 3 irradiates the photosensitive drum 1*b* in a predetermined position thereof by light passing through the optical path 3*b*, constituting a second optical path, thereby forming a second electrostatic image based on the image signal.

Similarly, the photosensitive drums 1*c*, 1*d* constituting the third and fourth image bearing members, are charged at a predetermined polarity and a predetermined potential, by the charging rollers 2*c*, 2*d* constituting the third and fourth charging means. Then, the exposure apparatus 3 irradiates the photosensitive drums 1*c*, 1*d* in a predetermined position thereof by light passing through the optical paths 3*c*, 3*d* constituting third and fourth optical paths, thereby forming third and fourth electrostatic images based on the image signal.

The developing apparatuses 4 (4*a*, 4*b*, 4*c*, 4*d*) contain predetermined amounts of developers formed respectively by mixing non-magnetic toners of yellow, magenta, cyan and black with magnetic carriers in predetermined mixing ratios, and develop the latent images on the photosensitive drums 1 with the respective color toners to form toner images, which are primary transferred onto the intermediate transfer belt 12.

The first electrostatic image, formed on the photosensitive drum 1*a*, is developed by the developing apparatus 4*a* as the first developing means thereby forming a yellow toner image as a first toner image. Also, the second electrostatic image, formed on the photosensitive drum 1*b*, is developed by the developing apparatus 4*b* as the second developing means thereby forming a magenta toner image as a second toner image.

Similarly the third and fourth electrostatic images, formed on the photosensitive drums 1*c* and 1*d*, are respectively developed by the developing apparatuses 4*c*, 4*d* as the third and fourth developing means thereby forming cyan and black toner images as third and fourth toner images.

The yellow toner image is primary transferred by the primary transfer apparatus 7*a* as the first primary transfer means, onto the intermediate transfer belt 12. The magenta toner image is primary transferred by the primary transfer apparatus 7*b* as the second primary transfer means, onto the intermediate transfer belt 12 in such a manner as to be superposed on the yellow toner image thereon.

Similarly, the cyan and black toner images are primary transferred by the primary transfer apparatuses 7*c*, 7*d* as the third and fourth primary transfer means, onto the intermediate transfer belt 12 in such a manner as to be superposed on the toner images thereon.

On the other hand, a recording material S, contained in a recording material cassette 13, is conveyed to a secondary transfer roller (secondary transfer member) 11 constituting a secondary transfer apparatus or secondary transfer means, and the toner images (yellow, magenta, cyan and black toner images) borne on the intermediate transfer belt 12 are secondary transferred onto thus fed recording material S. The recording material S, bearing the transferred toner images, is subjected, in a fixing apparatus 9, to heat and pressure in order to fix the toner images, and is discharged as a recorded image from the apparatus.

At a downstream side of the secondary transfer position onto the recording material S, along the transport direction of the intermediate transfer belt, there is provided an intermediate transfer belt cleaning apparatus 14, for removing a fogging toner and a secondary transfer residual toner, remaining on the intermediate transfer belt 12.

On the other hand, primary transfer residual toners, remaining on the photosensitive drum 1 (1*a*, 1*b*, 1*c*, 1*d*), are cleaned by photosensitive drum cleaning apparatuses 5 (5*a*, 5*b*, 5*c*, 5*d*) formed by fur brushes or blades.

In the following, a registration correcting operation in the present embodiment will be explained.

Figure 2:
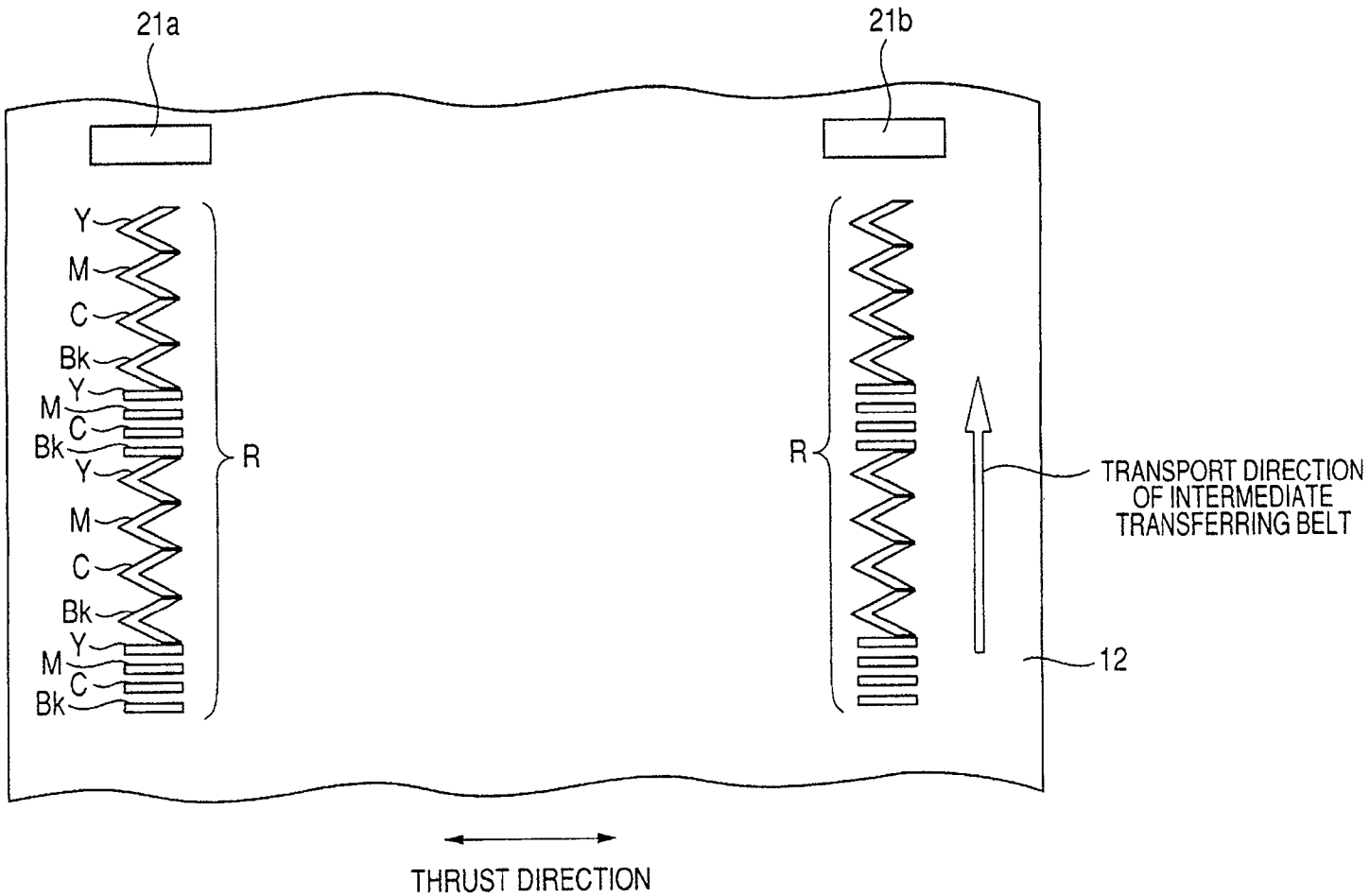
FIG. 2 is a view showing an example of a registration correcting pattern.

At first, correction pattern forming means reads out predetermined pattern data for registration correction, stored for example in an unillustrated ROM, and the photosensitive drums 1 (1*a*, 1*b*, 1*c*, 1*d*) are exposed, in the respective image forming stations P, by the lights respectively corresponding to yellow, magenta, cyan and black and coming through the optical paths 3*a*, 3*b*, 3*c* and 3*d* whereby a pair of electrostatic latent images of the registration correction pattern in two predetermined positions along the thrust direction (direction perpendicular to the conveying direction of the recording material). Such electrostatic latent images are developed with the respective color toners and then are primary transferred onto the intermediate transfer belt 12, whereby a registration correction pattern R as shown in FIG. 2 is formed thereon.

Pattern detection means (detection means) 21 (21*a*, 21*b*) are provided at a further downstream side of the image forming station Pd which is positioned most downstream in the image transport direction and in the vicinity of both lateral ends of the intermediate transfer belt 12 perpendicular to the transport direction thereof.

Figure 3:
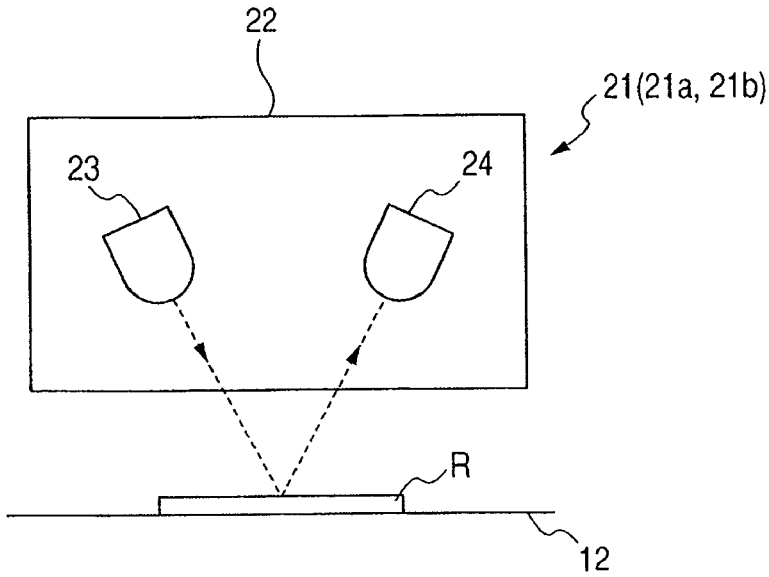
FIG. 3 is a cross-sectional view showing an example of pattern detection means.

Each of the pattern detection means 21 (21*a*, 21*b*) is formed, as shown in FIG. 3, by a light-emitting element 23 such as an LED and a photosensor 24 such as a photodiode or a CdS, and executes a pattern reading by irradiating the correction pattern R on the intermediate transfer belt 12 with the light from the light-emitting element 23 and receiving a reflected light, from the correction pattern R, by the photosensor 24.

Figure 4:
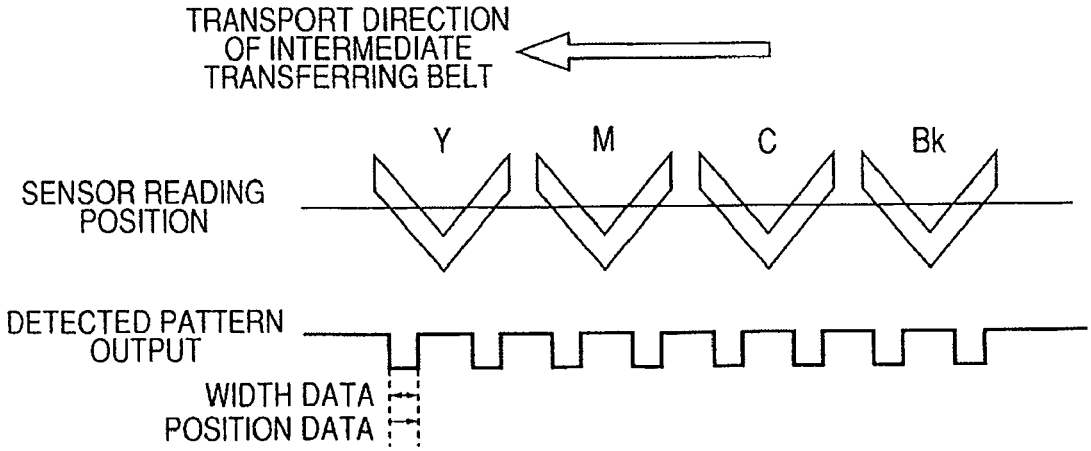
FIG. 4 is a view showing a correction pattern detection by the pattern detection means.

The pattern detection means 21 eliminates an erroneous detection, resulting from a scratch or a stain on the intermediate transfer belt 12, by rectifying the pattern width, and reads data of a pattern width and a pattern position of the correction pattern R as shown in FIG. 4. In this operation, the pattern detection means reads positions of magenta, cyan and black, with respect to the reference pattern position of the yellow toner.

Then, based on the result of detection by the pattern detection means 21, namely based on thus detected correction pattern data, and according to a table stored in a ROM 41 (FIG. 1) provided in the main body 100A of the image forming apparatus, the image signal to be recorded are subjected to an electrical correction and a correction by changes in the optical paths or the optical path lengths on the optical paths 3*a*, 3*b*, 3*c*, 3*d* by regulations of the plurality of mirrors 61 provided in the laser light optical paths, thereby achieving a correction on the registration. In such operation, in addition to a method of regulating all the mirrors 61 in the optical paths 3*a*, 3*b*, 3*c* and 3*d*, it is also possible not to regulate the mirror 61 for the optical path 3*a* of the light for irradiating the photosensitive drum 1*a* for forming the reference yellow toner image, but to regulate the mirrors 61 for the optical paths 3*b*, 3*c* and 3*d* for irradiating the photosensitive drums 1*b*, 1*c*, 1*d* for forming the magenta, cyan and black toner images.

Also for the electrical correction of the image signals, with respect to a time at which the photosensitive drum 1*a* is irradiated with the light from the exposure apparatus 3 based on the yellow image signal, times at which the photosensitive drums 1*b*, 1*c* and 1*d* are irradiated with the lights from the exposure apparatus 3 based on the magenta, cyan and black image signals, are regulated in the following manner.

Figure 14:
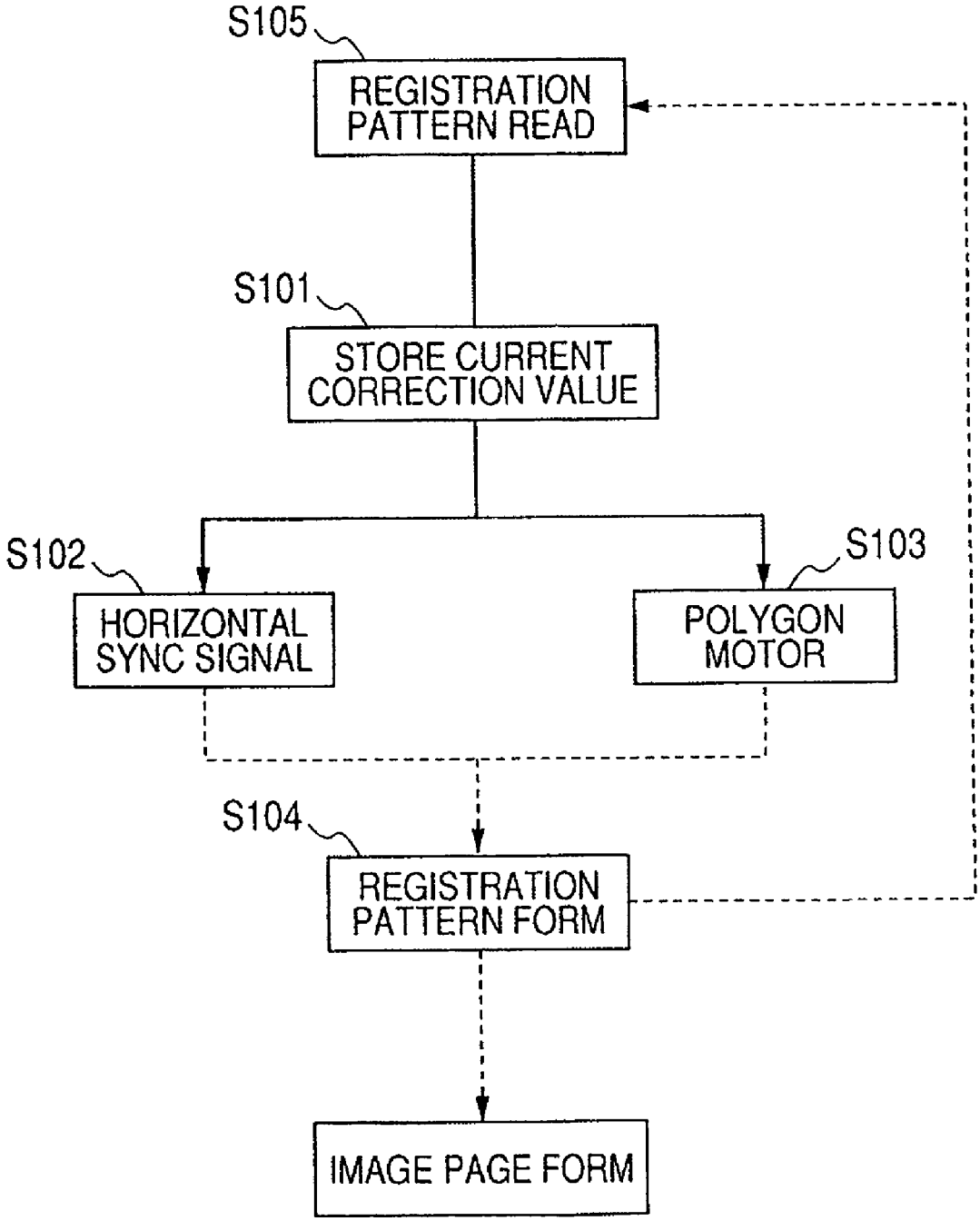
FIG. 14 is a view showing an algorithm in the correction of color registration error.

FIG. 14 shows an algorithm particularly in the correction for a color registration error.

Data, read in a step S105, of the correction pattern R formed on the intermediate transfer belt 12, are transmitted, in digital form, to an unillustrated holding portion for a color registration error correction value and stored therein in a step S101. The data are then transmitted to a controller 51 as leading end information of image formation for each color, and, according to such information, the controller 51 executes a color registration correction in a subsequent color image formation.

In a step S102, a horizontal sync signal counter 61 transmits a leading line timing signal, including the color registration error correction value, to an image processing block. At the same time, in a step S103, a control amount less than a pixel at the leading end position of image formation is taken as a phase control amount of a driving motor for the polygon mirror (hereinafter called a polygon motor), which is thus controlled to a phase level by a polygon motor control signal. The correction of color registration is thus executed by these controls, based on the color registration error information obtained from the registration pattern.

The "horizontal sync signal" mentioned above is a reference signal for a laser beam scanning by the rotation of the polygon motor (hereinafter called main scanning), and has a period corresponding to a signal from a photosensor provided outside an image area on the laser scanning line. The horizontal sync signal is used not only as a reference position for image formation in the main scanning direction but also as a count of the laser scanning lines in the transport direction (sub scanning direction) of the intermediate transfer belt 12. A repeated correction for the color registration error is executed by repeating the steps S104 and S105.

Figure 15:
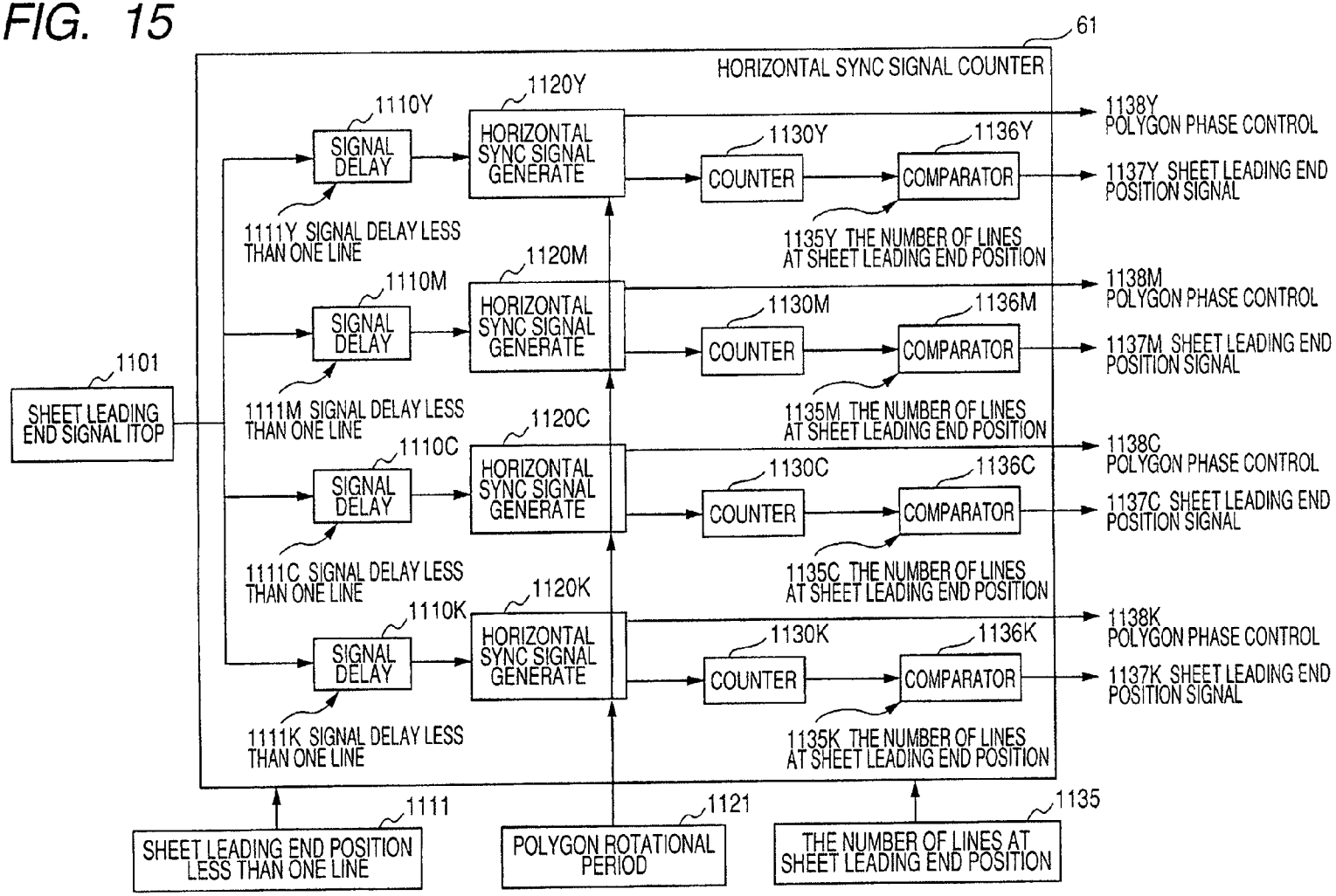
FIG. 15 is a schematic diagram showing an internal structure of a horizontal sync signal counter.
Figure 16:
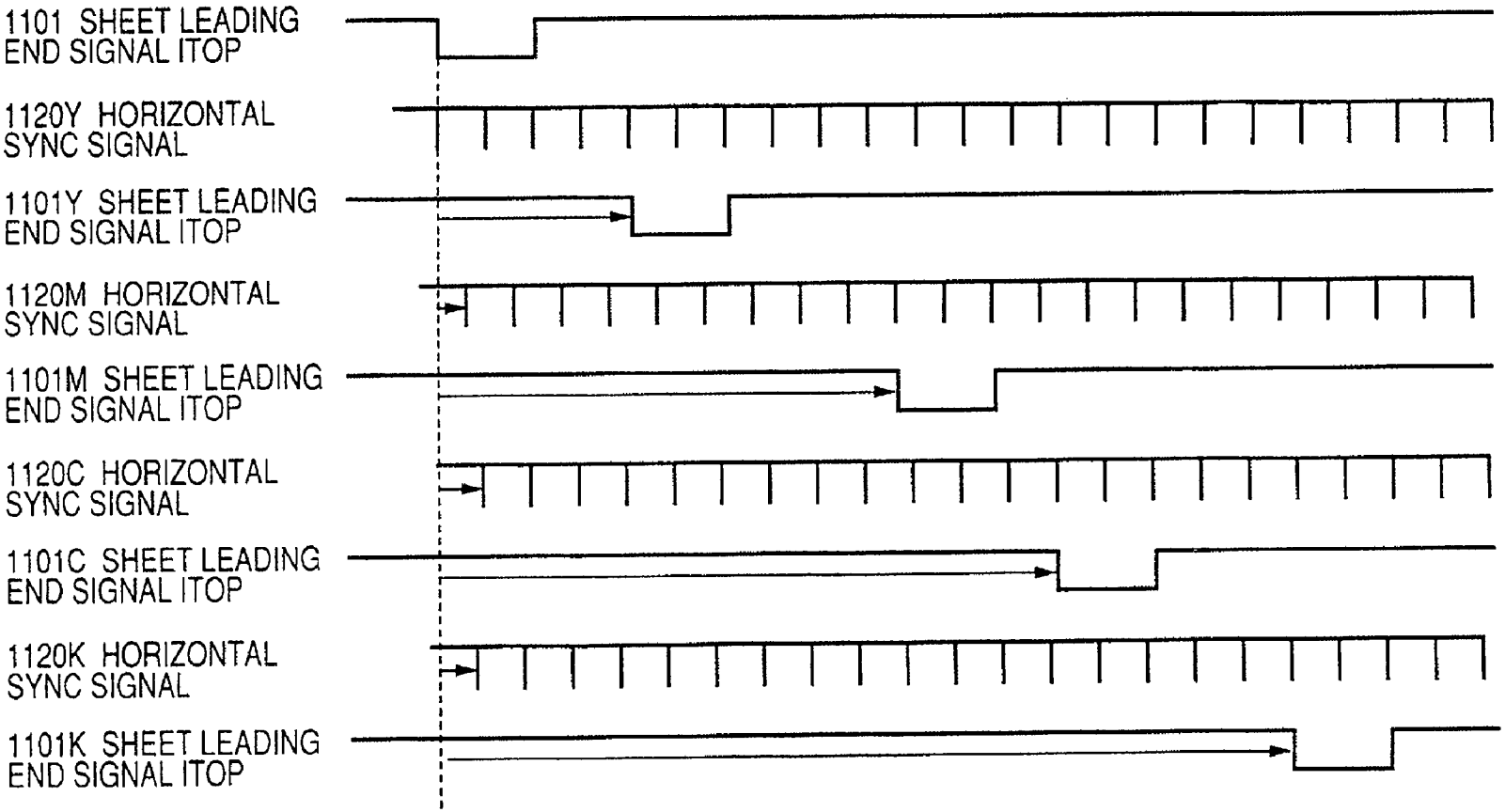
FIG. 16 is a chart showing signals in the horizontal sync signal counter.

FIG. 15 illustrates an internal structure of the horizontal sync signal counter 61, and FIG. 16 shows signals thereof in an operation example thereof. Now a color registration error correction in the sub scanning direction will be explained with reference to these figures.

A horizontal sync signal is started by a sheet leading end signal I-TOP 1101, indicating the start of an image formation. Then, a signal delay circuit 1110 adds, to the sub scanning, a delay corresponding to a correction amount for a color registration error of 1 line or less, and a horizontal sync signal generator 1120 generates a horizontal sync signal at such corrected phase.

The generated horizontal sync signal is used as a reference signal 1138 for the rotation phase control of the polygon motor. The horizontal sync signals are counted by a counter 1130, from the sheet leading end signal ITOP 1101, and a leading end position signal 1137 is generated when a matching with a predetermined leading end position 1135 is found in a comparator. A polygon rotational period 1121 is a value selected common for four colors YMCK, matching an image forming speed of the image forming apparatus. A leading end position 1111 less than one line and a line number 1135 at the leading end position are values set for each of four colors YMCK, and reflect values transmitted from the holding portion for the color registration error correction value.

The main body 100A of the image forming apparatus is equipped with a controller 51 (cf. FIG. 1), which collectively controls an ordinary image formation, a predetermined pattern formation for registration correction, and a pattern reading of the registration correction pattern, according to control programs stored for example in the ROM 41.

In the following, timings of the registration correcting operation in the present embodiment will be explained with reference to FIGS. 5, 6, 7 and 8.

In the present embodiment, the registration correction is executed at an initial installation, at a replacement of an image forming unit incorporating an image forming part and at a start of power supply in the main body, and also when a number of image formations exceeds a predetermined number. Such predetermined number is changed depending on a length of the recording material S for image formation, in the thrust direction.

A cause of the registration error among the image forming stations Pa, Pb, Pc and Pd is an internal temperature elevation in the apparatus by a plurality of image forming operations.

When the internal temperature of the apparatus is elevated, various members such as mirrors 61 and fθ lens holders are deformed by thermal expansion, whereby the laser lights from the exposure apparatus 3 show changes in the optical path lengths and in the optical paths. As the temperature elevation and the deformation of components are different among the image forming stations, an image defect is generated by a registration error when four colors are superposed on the recording material S. This phenomenon is particularly conspicuous in a structure disadvantageous for the temperature elevation, for example when the exposure apparatus 3 is provided close to the fixing apparatus 9 or various drive motors, or when the main body 100A is made compact with a high density of components therein. This phenomenon appears conspicuous when the mirrors and the fθ lens holders are formed with resinous members, as they have a large thermal expansion.

Figure 5:
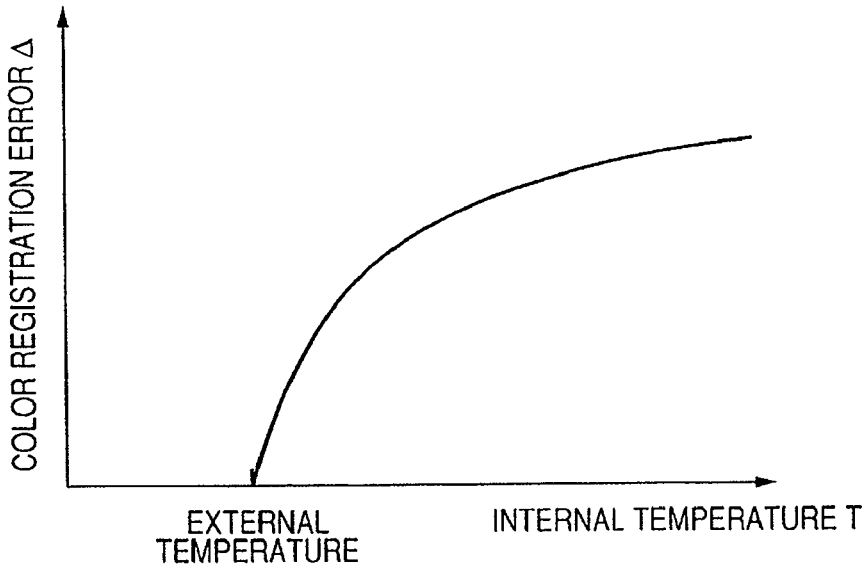
FIG. 5 is a chart showing a relationship between an internal temperature of apparatus and a color registration error.

FIG. 5 shows a relationship between an internal temperature of the image forming apparatus of the present embodiment, and a color registration error amount.

As shown in FIG. 5, the color registration error Δ is large for a given temperature change ΔT at the start of temperature elevation (i.e. at a low-temperature state), but the color registration error A is limited for a temperature change ΔT during a continuous image forming operation (high-temperature state). This is due to the characteristics of components showing a thermal expansion by a temperature elevation, in which the deformation by thermal expansion becomes smaller when a certain high temperature is reached.

As the color registration error Δ becomes large when the internal temperature of the apparatus is elevated, it is necessary to eliminate the color registration error by executing a registration correcting control before the error mount Δ is recognized as an image defect.

Figure 6:
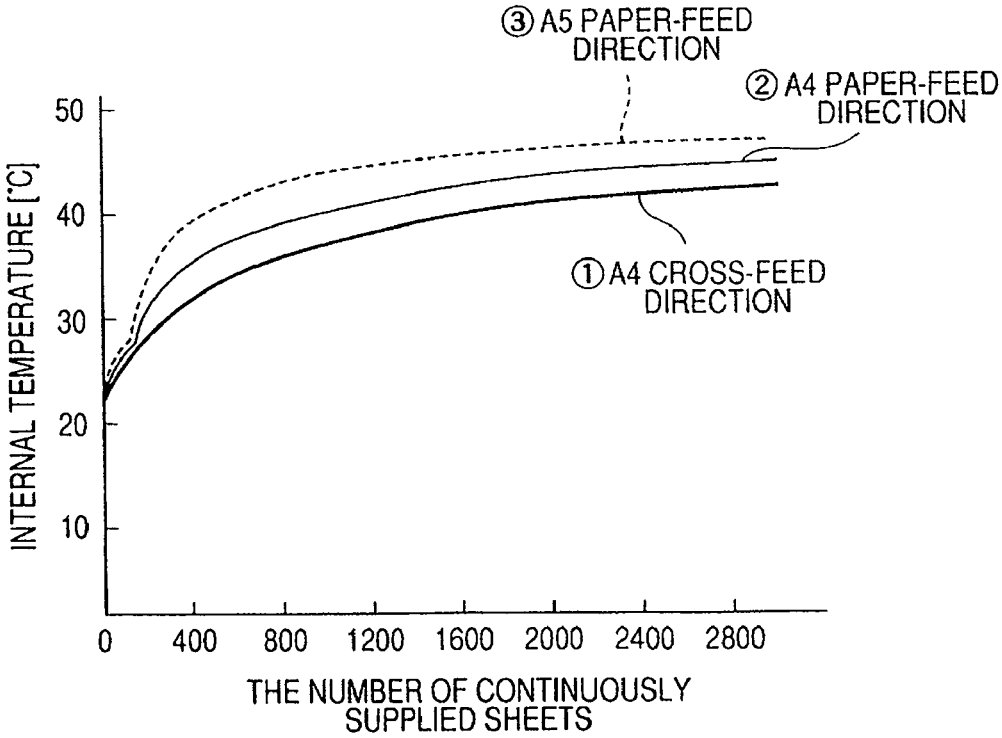
FIG. 6 is a chart showing an increase in the internal temperature of apparatus as a function of a number of continuously supplied sheets.

FIG. 6 shows the internal temperature elevation in a case of continuous printing operation, on the recording materials S of different lengths in the thrust direction.

This investigation was executed by measuring the change in the internal temperature of the apparatus, by mounting a temperature sensor such as thermistor in an optical housing of the exposure apparatus 3, showing a high correlation with the color registration error, and by repeating, in an external temperature of 23° C., the image forming operation on:

(1) A4-sized recording materials $S_1$ fed in a longitudinal direction (paper-feed direction);

(2) A4-sized recording materials $S_2$ fed in a cross direction; or (3) A5-sized recording materials $S_3$ fed in a longitudinal direction (paper-feed direction).

The above mentioned recording materials S, individually referred to as recording materials S and collectively referred to as recording materials S, have respective lengths of (1) 297 mm, (2) 210 mm, or (3) 148.5 mm, in the thrust direction.

In the image forming operation, as the recording materials $S_1$ and $S_3$ are shorter in length in the thrust direction in comparison with the recording material $S_1$, sheet non-passing areas are formed in the end portions, in the thrust direction, of the fixing apparatus 9, and such sheet non-passing areas do not show a temperature decrease because the heat is not absorbed by the passing recording material S.

For this reason, when a temperature control is conducted so as to maintain a predetermined temperature for securing the fixing property in a portion where the recording material S passes, the temperature of the fixing apparatus 9 becomes higher. Therefore, the main body 100A of the image forming apparatus shows a rapid temperature elevation. In case of employing a thin fixing roller or a thin fixing belt in the fixing apparatus 9 in order to shorten the heat-up time to the fixing temperature, the sheet non-passing areas become excessively hot due to the limited heat capacity of the fixing roller or the fixing belt, thus leading to an image defect such as a hot offset phenomenon or to a breakage or a deterioration of the components of the fixing apparatus.

Therefore, in case of image printing on recording materials S with a short length in the thrust direction, it is necessary to adopt measures of reducing the image forming speed, expanding the gap between the recording materials and to interrupt the heating of the fixing apparatus 9, thereby reducing the temperature. In such state, even though the heating of the fixing apparatus is interrupted, the photosensitive drum and the intermediate transfer belt in the image forming apparatus continue to run, so that the apparatus still shows an elevation in the internal temperature.

Therefore, as shown in FIG. 6, the internal temperature of the apparatus shows a faster elevation for given a number of sheets fed for image printing, for a shorter length of the recording material S in the thrust direction.

Figure 7:
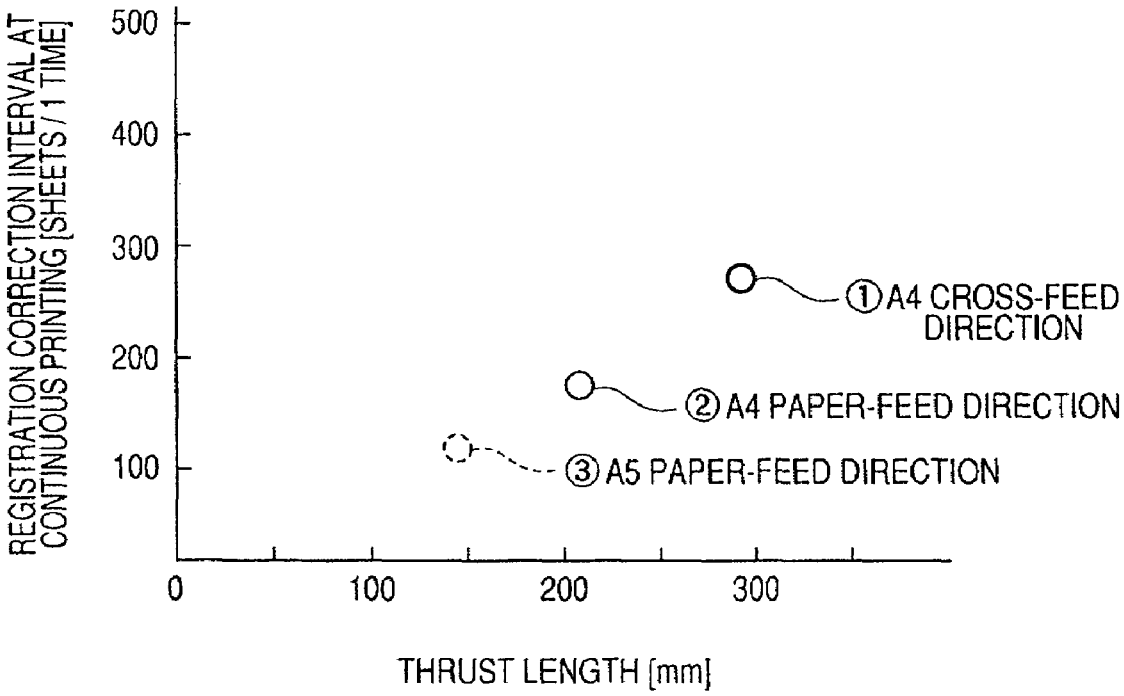
FIG. 7 is a chart showing a relationship between a length of the recording material in the thrust direction and a registration correcting frequency.

Therefore, as shown in FIG. 7, the interval of the registration correction control is changed according to the length in thrust direction of the recording material S to be used for continuous image printing.

In the present embodiment, in case of continuous image forming operation on a recording material S with a length of 250 mm or more in the thrust direction, the registration correction control is executed by interrupting the continuous image forming operation at a frequency of every 300 sheets. The image forming operation is re-started after the registration correction control. Stated differently, the interval of the registration correction control is made longer in case of continuous image printing operation on the recording materials S having a length of 250 mm or larger.

On the other hand, in case the length in the thrust direction is less than 250 mm, the frequency of the registration correction controls is increased. Thus the interval of the registration correction controls is made shorter. For example, the registration correction control is executed at a frequency of every 177 sheets in the case of recording material $S_2$ A4-sized sheets fed in a cross direction, and every 120 sheets in the case of recording material $S_3$ A5-sized sheets fed in paper-feed direction (with a length of 148 mm in the thrust direction). For the recording materials S of other sizes, it is possible to determine the frequency of the registration correction control by a calculation in proportion to the length of the recording material in the thrust direction, or to divide the length in the thrust direction into plurality of ranges and to select a frequency of the registration correction control in each of such a plurality of ranges.

Therefore, for a length in the thrust direction of 250 mm or larger, the registration correction control is executed twice for 600 sheets, and, for A5-sized sheet fed in paper-feed direction, it is executed five times for 600 sheets.

Thus, the frequency of the registration correction per a given number of the recording materials to be subjected to the toner image fixation in the fixing apparatus 9 is variably controlled according to the thrust length of the recording materials. Such frequency is made higher for a shorter thrust length of the recording material.

Such frequency of the registration correction controls is determined in the following manner. In a color image forming apparatus, the amount of registration error among the colors is desirably 150 μm or less, preferably 100 μm or less.

However, as shown in FIG. 5, the color registration error Δ becomes larger when the internal temperature of the apparatus is elevated. In the image forming apparatus of the present embodiment, the color registration error is about 10 μm for a temperature change ΔT of 1° C. in a low-temperature state showing a large color registration error Δ for a temperature change ΔT, and it is several μm for a temperature change ΔT of 1° C. in a high-temperature state.

In addition to the elevation of the internal temperature of the apparatus, a color registration error of tens of micrometers is also induced by a fluctuation in the running stability of the photosensitive drum 1 and the intermediate transfer belt 12, or by a reading error of the registration correction pattern, the registration correction control must be executed before the internal temperature of the apparatus rises by 5° C. in order to obtain the desired color registration error of 100 μm or less, and thus the frequency was determined from the result of measurement of the temperature elevation.

As the color registration error varies depending on the structure of the image forming apparatus and the material constituting the component parts, the frequency is not limited to the afore-mentioned values but is suitably selected according to the image forming apparatus.

Figure 8:
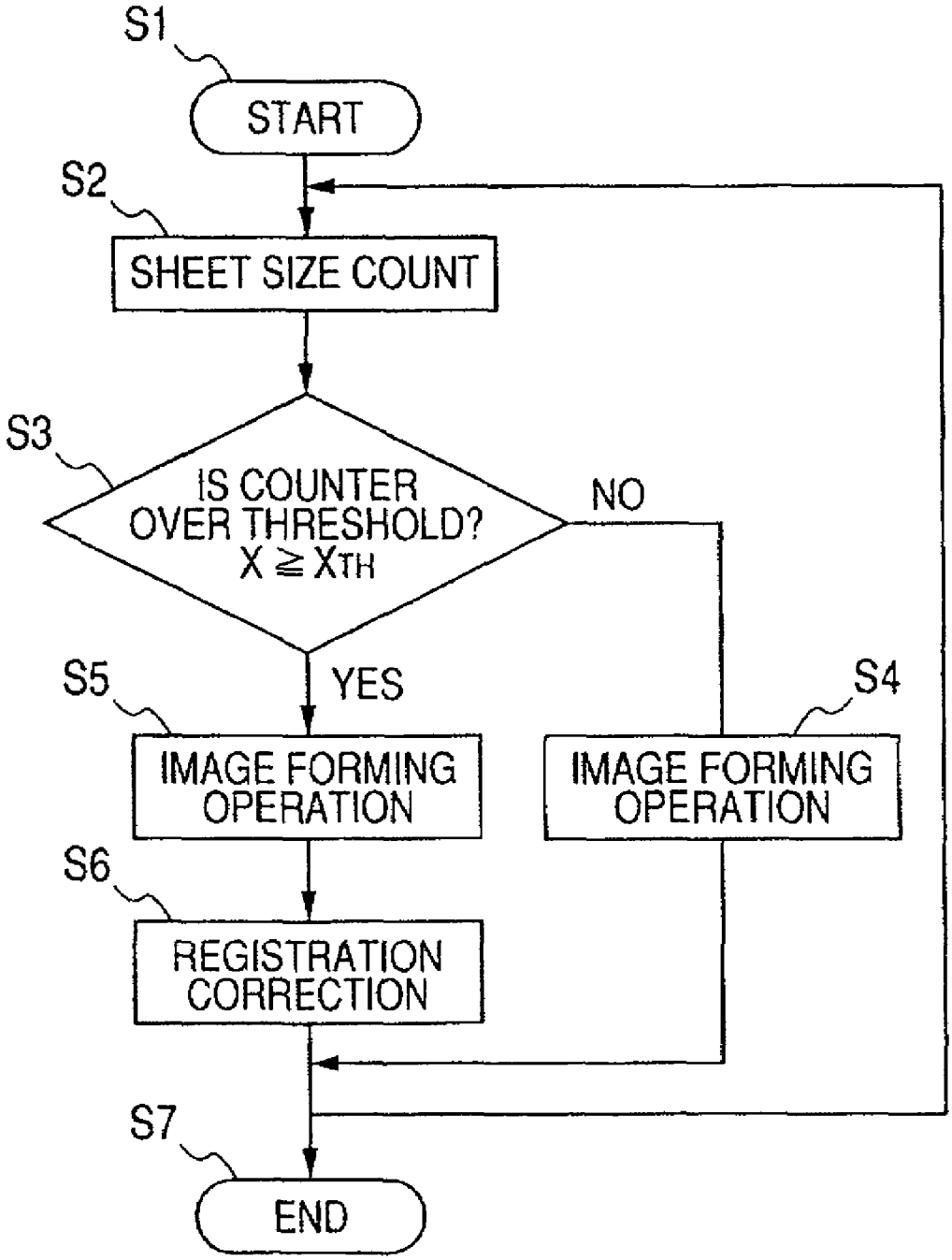
FIG. 8 is a flowchart showing a timing of the registration correcting operation in an embodiment 1.

FIG. 8 shows a flowchart of the registration correction operation in the embodiment 1.

At first, when the operation of the image forming apparatus is started (S1), a sheet size of the recording material for image printing is recognized, and a sheet size counter in a frequency controller 511 executes a count (S2). The sheet size counter has different count values for each image printing depending on the sheet size, and a larger count value for a shorter thrust length of the recording material, for example 1 count for an A4-sized sheet fed in cross-feed direction, 1.7 counts for an A4-sized sheet fed in longitudinal (paper-feed) direction, and 2.5 counts for an A5-sized sheet fed in longitudinal (paper-feed) direction. The counter accumulates such count values. Also a recording material having a length, in the transport direction, equal to or larger than a predetermined value, for example 364 mm or larger, such recording material is considered as a large size and the count value is doubled.

If the cumulative count value (X) is less than a threshold value ($X_{TH}$)(=300 in the present embodiment), namely in case of NO in a step S3, an image forming operation is executed (S4) and the sequence is terminated (S7). If necessary the image forming operation is repeated, and, in this case, the sequence returns to the step S2 for executing counting by the sheet size counter.

If case the cumulative count value (X) is equal to or larger than a threshold value ($X_{TH}$)(=300 in the present embodiment), namely in case of YES in the step S3, an image forming operation is executed (S5) and then a registration correction operation is executed (S6), then the sequence is terminated (S7). When the image forming operation is repeated, it is re-started after the registration correction operation. Also the sheet size counter is reset upon the registration correction operation.

The registration correction operation is executed at the afore-mentioned frequency when a same sheet size continues, but, when a plurality of recording materials different in sheet size are mixed, the timing of operation and the frequency of control in the image formations are determined based on the count value. The timing of operation and the frequency of control are controlled by the frequency controller 511.

According to the present invention, as explained in the foregoing, in an image forming apparatus utilizing an intermediate transfer member formed, for example as an endless belt (or a recording material conveying member formed, for example, as an endless belt, as will be explained later), when a small-sized recording material is used continuously, an appropriate registration correction can always be executed against a change in the registration, resulting from a thermal expansion of the optical path components such as mirrors or fθ lens holders, induced by an internal temperature elevation in the image forming apparatus as a result of many image forming operations, thus providing high-quality images with little color registration error.

In particular, the present embodiment changes the frequency of the registration correction depending on the length, in the thrust direction, of the recording material for image formation, thereby providing a stable image forming apparatus with little color registration error capable of appropriately correcting the color registration error, caused by an internal temperature elevation resulting from the temperature elevation in sheet non-passing areas, formed in the fixing apparatus when the recording material has a short thrust length, before giving rise to an image defect.

Figure 9:
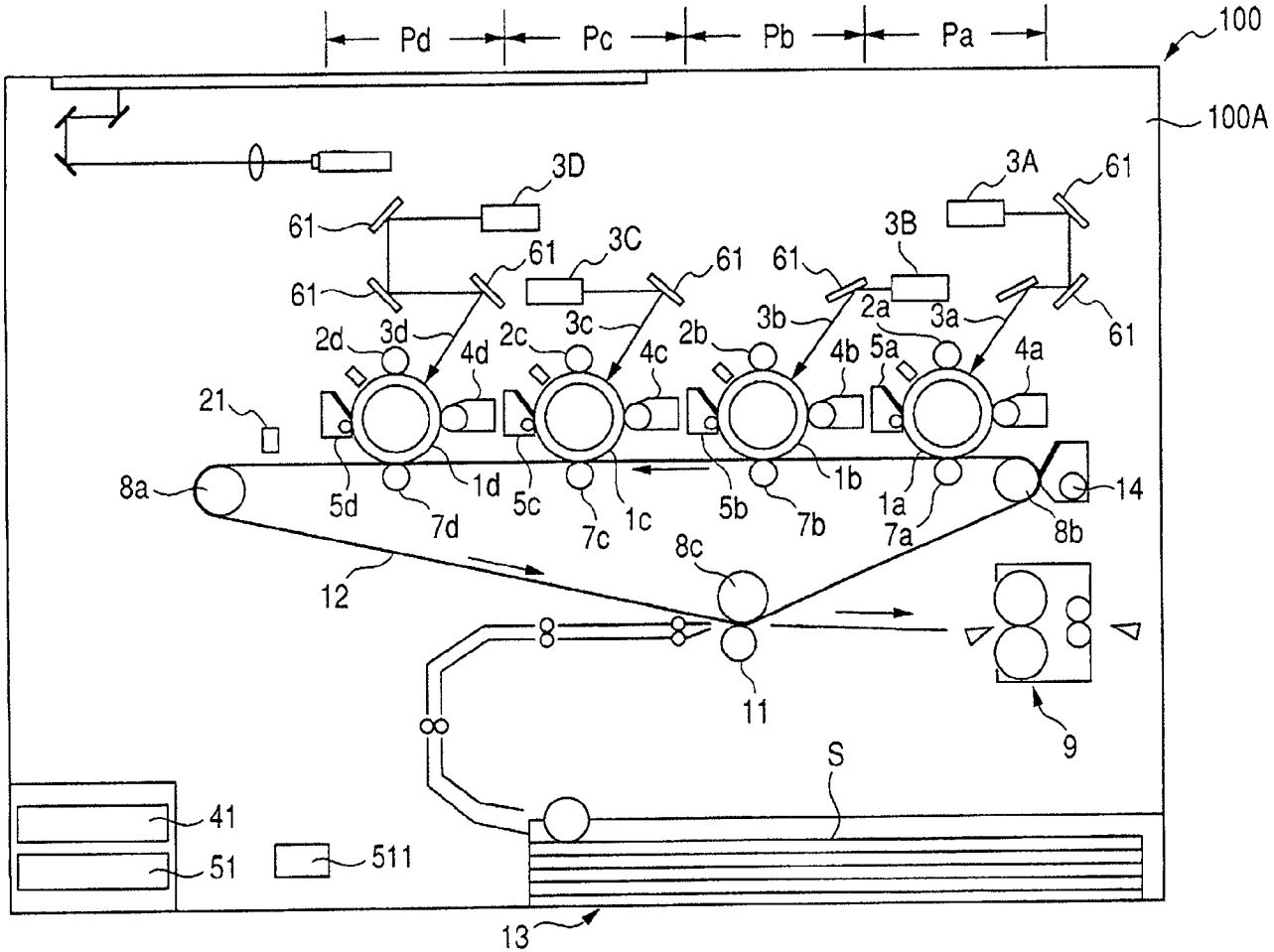
FIG. 9 is a view showing another embodiment of the image forming apparatus of the present invention.

FIG. 9 illustrates a modification of the image forming apparatus of the embodiment 1, in which components equivalent in structure and function to those in the image forming apparatus shown in FIG. 1 are represented by same numbers and will not be explained further.

In the image forming apparatus shown in FIG. 9, exposure apparatuses 3A, 3B, 3C and 3D are provided for respectively exposing the photosensitive drums 1*a*, 1*b*, 1*c* and 1*d*, thereby forming electrostatic images.

In the embodiment shown in FIG. 1, the exposure apparatus 3 is used for exposing all the photosensitive drums 1*a*, 1*b*, 1*c* and 1*d*, but, in the modified embodiment shown in FIG. 9, the photosensitive drums 1*a*, 1*b*, 1*c* and 1*d* are respectively exposed by the exposure apparatuses 3A, 3B, 3C and 3D. Such a modified embodiment also provides similar effects.

Embodiment 2

In the following, an embodiment 2 of the present invention will be explained with reference to FIGS. 10 and 11.

In the embodiment 1, at a timing of the registration correction operation, a registration correction operation is executed after an image forming operation, and a next image forming operation is started after the registration correction operation. On the other hand, in the present embodiment, when the recording material has a short thrust length, a registration correction pattern is formed in an external end portion of the image area in the course of an image forming operation, thereby executing a correction control.

As the image forming apparatus of the present embodiment has a structure the same as that of the embodiment 1, the description therefor in the embodiment 1 is applicable. Thus, components equivalent in structure and function to those in the embodiment 1 are represented by same reference numerals and characters and will not be explained further.

Figure 10:
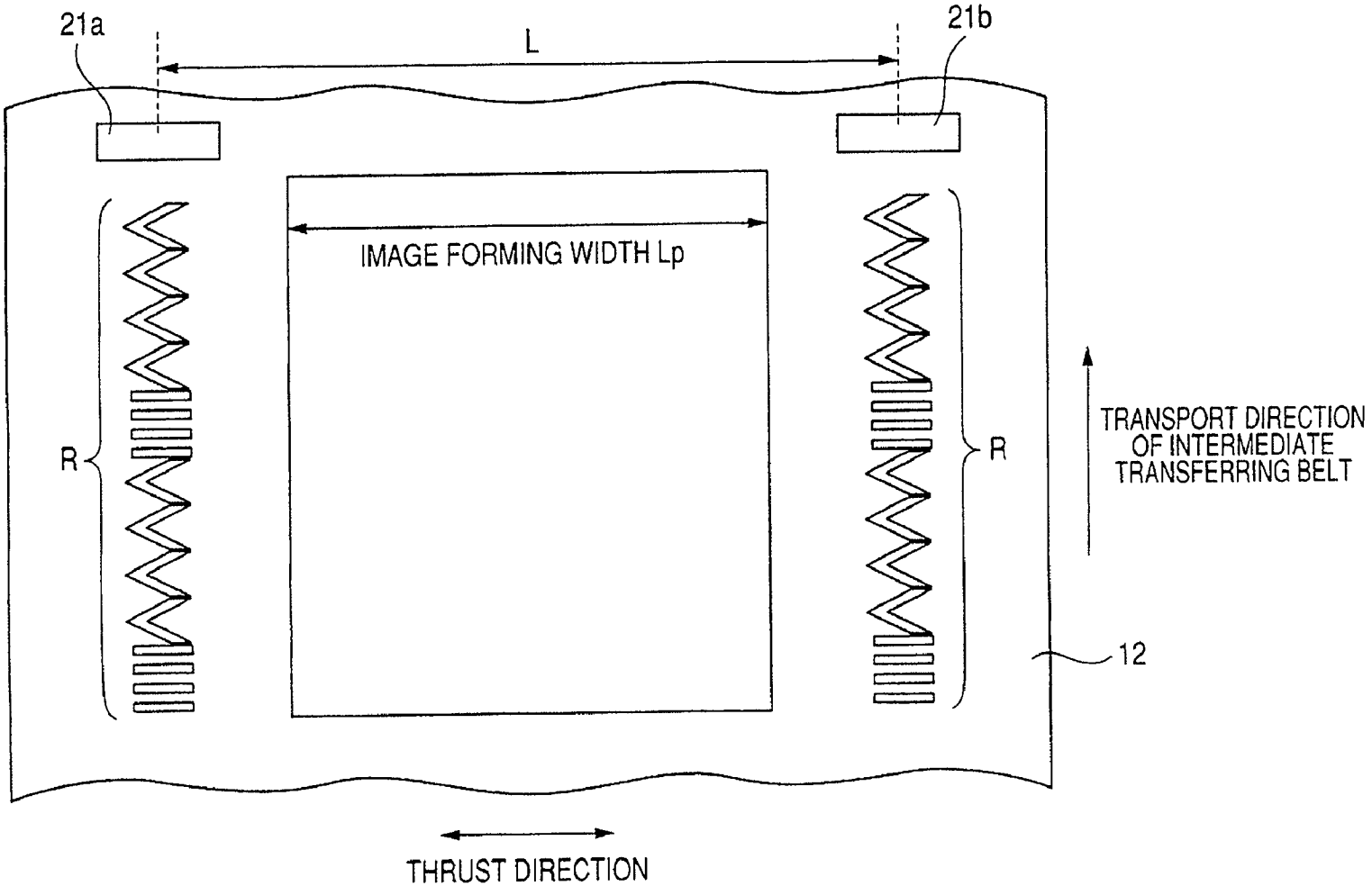
FIG. 10 is a view showing another example of the registration correction pattern.

In the present embodiment, the image forming apparatus is provided, as shown in FIG. 10, a pair of pattern detection means 21 (21*a*, 21*b*) with a mutual distance L, perpendicularly to the transport direction of the intermediate transfer belt 12, and L=265 mm in the present embodiment. As a larger mutual distance L of the paired pattern detection means 21 provides a higher precision for correction, the pattern detection means are preferably provided in the vicinity of both end portions of an area capable of forming the registration correction patterns.

In the present embodiment, for example in case of image printing on an A4-sized recording material S fed in the cross direction, an image forming width Lp on the recording material is 297 mm, and the pattern detection means 21*a*, 21*b* are positioned within the image forming area. Therefore, at the timing of registration correction operation, a registration correction control is executed after the image forming operation is completed, and the image forming operation is thereafter re-started. In contrast, in case of image printing on an A4-sized recording material S fed in the longitudinal (paper-feed) direction, an image forming width Lp on the recording material is 210 mm, so that the pattern detection means 21*a*, 21*b* are positioned outside the image forming area. In such case, registration correction pattern may be formed outside the image forming area simultaneously with the image forming operation, without inducing an image defect such as a toner stain on the output recording material.

In the present embodiment, therefore, if the recording material has a length of 250 mm or less in a direction perpendicular to the transport direction thereof, registration correction patterns are formed outside the image forming area, and a registration correction control is executed while an image forming operation is conducted. Thus the registration correction pattern is formed, in the transport direction of the intermediate transfer member, within a region from a leading end position to a trailing end position of the toner image to be transferred onto the recording material S.

Also, the timing of the registration correction operation is the same as in the embodiment 1. Stated differently, the frequency of the registration correction control is increased when the recording material has a thrust length of 250 mm or less, as explained in the embodiment 1.

Figure 11:
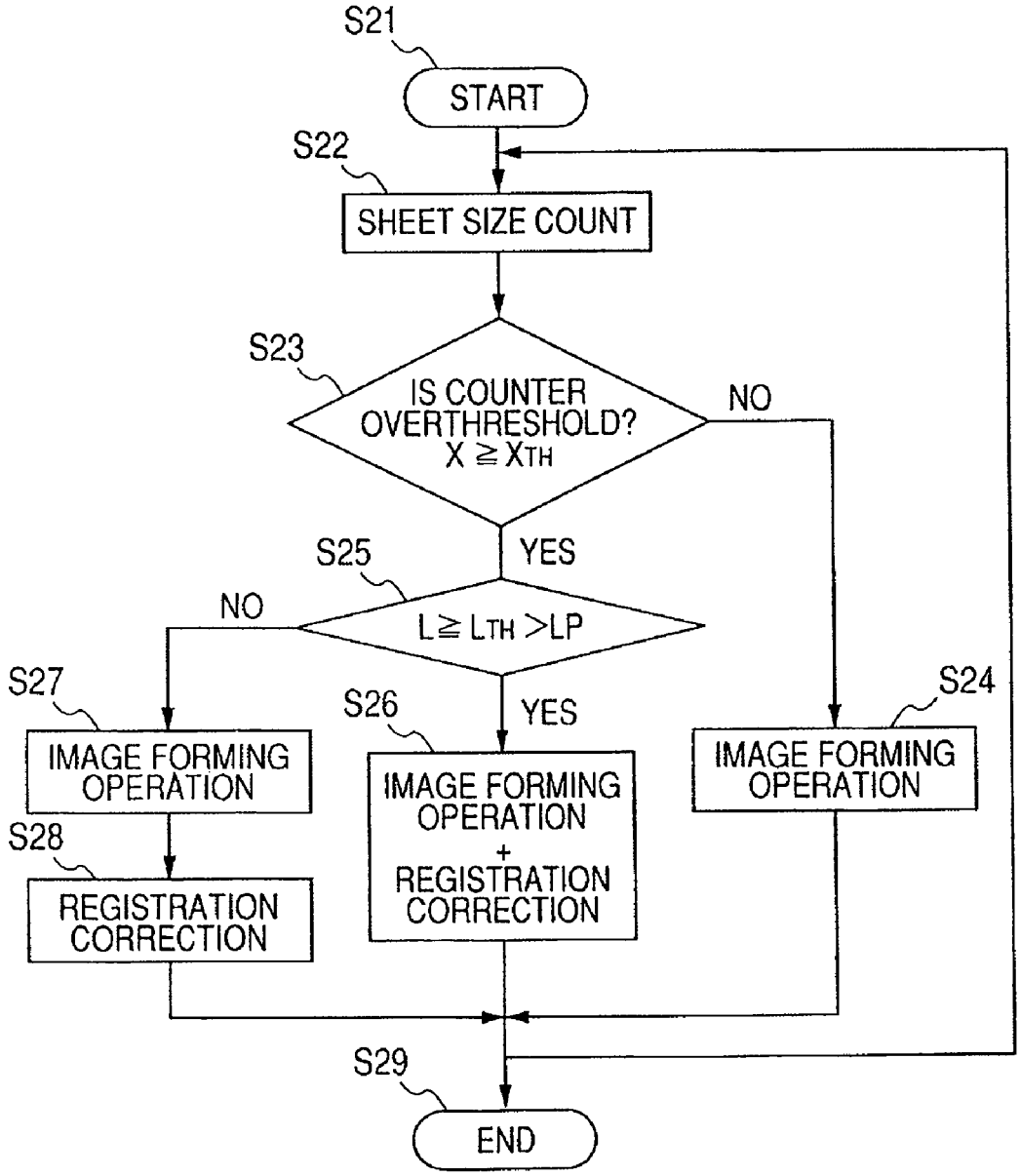
FIG. 11 is a flowchart showing a timing of a registration correcting operation and an operation mode in an embodiment 2.

These operations are shown in a flowchart, shown in FIG. 11.

Thus, FIG. 11 is a flowchart of the registration correction operation in the embodiment 2.

At first, when the operation of the image forming apparatus is started (S21), a sheet size of the recording material for image printing is recognized, and a sheet size counter in a controller 511 executes a counting (S22). The sheet size counter has different count values for each image printing depending on the sheet size, and a larger count value for a shorter thrust length of the recording material, for example 1 count for an A4-sized sheet fed in a cross-feed direction, 1.7 counts for an A4-sized sheet fed in a longitudinal (paper-feed) direction, and 2.5 counts for an A5-sized sheet fed in the longitudinal (paper-feed) direction. The counter accumulates such count values. Also a recording material having a length, in the transport direction, equal to or larger than 364 mm or larger, such recording material is considered as a large size and the count value is doubled.

If the cumulative count value (X) is less than a threshold value ($X_{TH}$) (=300 in the present embodiment), namely in case of NO in a step S23, an image forming operation is executed (S24) and the sequence is terminated (S29). If necessary, the image forming operation is repeated, and, in this case, the sequence returns to the step S22 for executing counting by the sheet size counter.

If the cumulative count value (X) is equal to or larger than a threshold value ($X_{TH}$) (=300 in the present embodiment), namely in case of YES in the step S23, then a length Lp of the recording material to be used, in a direction perpendicular to the transport direction thereof, is compared with a predetermined length $L_{TH}$ ($L_{TH} \leqq L$) (in the present embodiment, L=265 mm and Lp=250 mm) (S25).

If the length Lp of the recording material in the direction perpendicular to the transport direction thereof is less than the predetermined length $L_{TH}$ (250 mm in the present example), namely in case of YES in S25, registration correction patterns are formed outside the image forming areas and a registration correction control is executed during an image forming operation (S26).

The timing of the registration correction operation is same as in the embodiment 1. Stated differently, the frequency of the registration correction control is increased when the recording material has a thrust length of 250 mm or less, as explained in the embodiment 1.

If the length Lp of the recording material in the direction perpendicular to the transport direction thereof is equal to or larger than the predetermined length $L_{TH}$ which is 250 mm in the present embodiment (in case of NO in S25), an image forming operation is executed (S27). Then, after the completion of the image formation on the recording material, a registration correction operation is executed (S28), and the sequence is terminated (S29). If the image forming operation is repeated, it is started after the registration correction control. Also the sheet size counter is reset upon the registration correction operation.

The registration correction operation is executed at the afore-mentioned frequency when a same sheet size continues, but, when plurality of recording materials different in sheet size are mixed, the timing of operation in the image formations is determined based on the count value. The timing of operation and the frequency of control are controlled by the frequency controller 511.

In the embodiment 1, the number of registration correction controls increases when the image formations are executed on the recording materials of smaller size, whereby the interruption of the image forming operations, by the registration correction operation, becomes longer.

In the present embodiment, in contrast, the image forming operations are not interrupted as the registration correction control can be executed during the image forming operation.

As explained above, the present embodiment changes the frequency of the registration correction depending on the length, in the thrust direction, of the recording material for image formation, and forms the registration correction patterns outside the image forming area in case the thrust length of the recording material is shorter than the distance of the paired pattern detection means to enable executing the registration correction control during the image forming operation, thereby attaining effects similar to those of the embodiment 1, and providing a stable image forming apparatus with little color registration error capable of appropriately correcting the color registration error, caused by an internal temperature elevation resulting from the temperature elevation in sheet non-passing areas, formed in the fixing apparatus when the recording material has a short thrust length, before giving rise to an image defect.

Embodiment 3

The present embodiment utilizes an image forming apparatus of a multiple-transfer type, in which an image is formed by image forming means on a photosensitive drum and is directly transferred onto a recording material S, conveyed by a recording material conveying belt serving as a recording material conveying member (recording material conveying member). The method of executing the registration correction control according to the size (length in thrust direction) of the recording material S, to be fixed in the fixing apparatus 9, explained in the embodiments 1 and 2, is also employed in the present embodiment.

Figure 12:
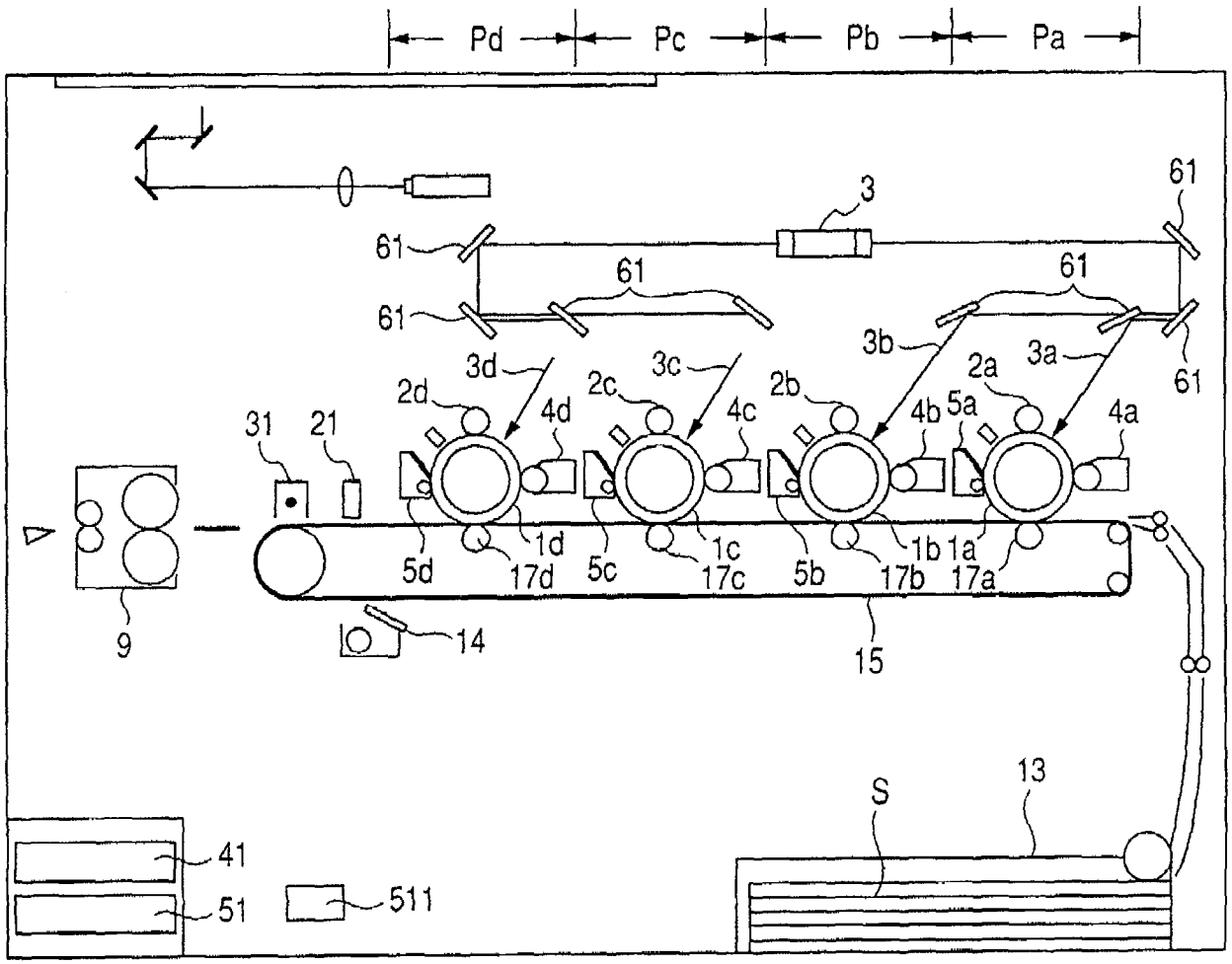
FIG. 12 is a view showing another embodiment of the image forming apparatus of the present invention.

FIG. 12 illustrates an image forming apparatus of the present embodiment, in which components equivalent in structure and function to those in the embodiments 1 and 2 will be represented by same numbers and will not be explained further.

Image forming parts P (Pa, Pb, Pc, Pd) are respectively provided exclusive image bearing members (photosensitive drums) 1 (1*a*, 1*b*, 1*c*, 1*d*), on which toner images of respective colors are formed. A transfer belt 15 is provided adjacent to the photosensitive drums (image bearing members) 1*a*, 1*b*, 1*c* and 1*d*, and the toner images of respective colors, formed on the photosensitive drums, are transferred onto a recording material S, which is borne and conveyed by the transfer belt 15, under a bias application to transfer rollers (transfer members) 17 (17*a*, 17*b*, 17*c*, 17*d*) from an unillustrated power source. Then, the recording material S, having received the transferred toner images, is separated from the transfer belt 15 by a separating charger 31, then is the recording material S is subjected to a fixation of the toner images by heat and pressure applied in the fixing apparatus (fixing means) 9, and then the recording material S is discharged as a recorded image from the apparatus.

Also in this embodiment, the registration correction is executed in a similar manner as in the embodiments 1 and 2, and the frequency of the registration correction is variably controlled according to the length of the recording material in the thrust direction. In the registration correction of the present embodiment, the registration patterns formed on the photosensitive drums 1 (1*a*, 1*b*, 1*c*, 1*d*) are directly transferred onto the transfer belt and are detected by the sensor 21.

Thus, also in an image forming apparatus utilizing a recording material conveying belt, the color registration error resulting in case of a temperature elevation caused by the fixing apparatus 9 can be appropriately corrected before giving rise to an image defect.

Also in the present embodiment, in case of an image formation on a recording material S with a short thrust length, such as an A4-sized sheet fed in longitudinal (paper-feed) direction, the registration correction patterns are formed, in the transport direction of the recording material conveying belt, within a region from a leading end position to a trailing end position of the toner image on the recording material S.

Figure 13:
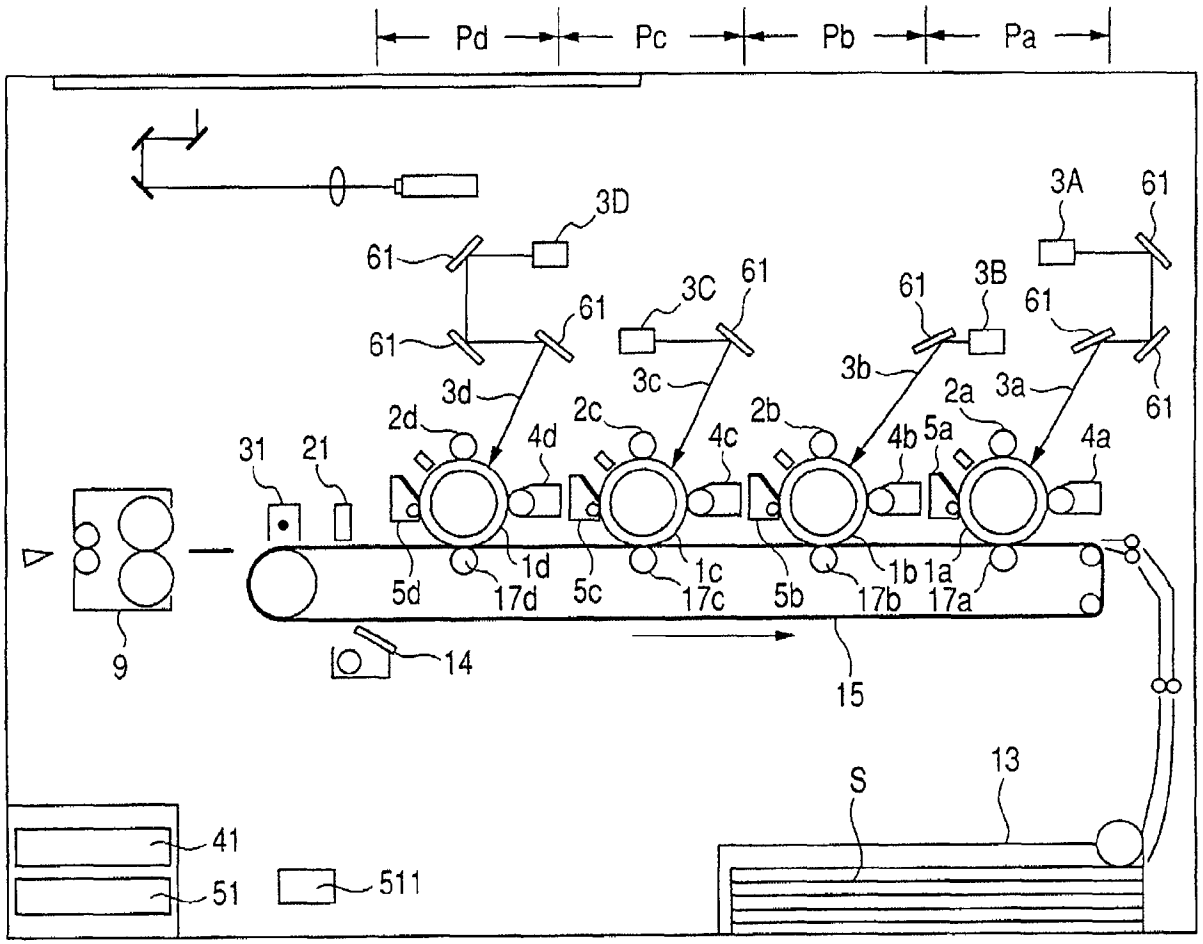
FIG. 13 is a view showing another embodiment of the image forming apparatus of the present invention.

FIG. 13 illustrates a modification of the image forming apparatus of the present embodiment, in which components equivalent in structure and function to those in the image forming apparatus shown in FIG. 12 (or in FIG. 1 or 9) are represented by same reference numerals and characters and will not be explained further.

In the image forming apparatus shown in FIG. 13, exposure apparatuses 3A, 3B, 3C and 3D are provided for respectively exposing the photosensitive drums 1*a*, 1*b*, 1*c* and 1*d*, thereby forming electrostatic images.

In the embodiment shown in FIG. 12 (or FIG. 1), the exposure apparatus 3 is used for exposing all the photosensitive drums 1*a*, 1*b*, 1*c* and 1*d*, but, in the modified embodiment shown in FIG. 13, the photosensitive drums 1*a*, 1*b*, 1*c* and 1*d* are respectively exposed by the exposure apparatuses 3A, 3B, 3C and 3D. Such a modified embodiment also provides similar effects.

This application claims priority from Japanese Patent Application No. 2005-165453 filed Jun. 6, 2005, which is hereby incorporated by reference herein.

What is claimed is:

1. An image forming apparatus comprising:

a first image forming portion which includes a first image bearing member, and which forms a first toner image on the first image bearing member;

a second image forming portion which includes a second image bearing member, and which forms a second toner image on the second image bearing member;

a belt member which bears a first toner image transferred from the first image bearing member, and which bears a second toner image transferred from the second image bearing member so as to superpose the second toner image on the first toner image transferred from the first image bearing member;

a transfer part which transfers the first and second toner images onto a recording material;

a fixing apparatus which fixes the first and second toner images on the recording material using heat;

a detection part which detects a first alignment toner image transferred from the first image bearing member onto the belt member, and which detects a second alignment toner image transferred from the second image bearing member to the belt member;

an adjusting part which adjusts an image forming condition of one of the first image forming portion and the second image forming portion due to the detection of the first and second alignment toner images by the detection part; and a recording material detection portion which detects a size of the recording material at least in a direction perpendicular to a transport direction of the recording material; and a control portion which, in a continuous image forming job for continuously forming images on the recording material, increases a frequency of execution of the adjusting portion when the size of the recording material in the direction perpendicular to the transport direction of the recording material becomes smaller.

2. An image forming apparatus according to claim 1, wherein the control portion causes the adjusting part to execute per a predetermined number of image formations, and wherein the control portion decreases the number of image formations when the size of the recording material in the direction perpendicular to the transport direction of the recording material becomes smaller.

3. An image forming apparatus according to claim 1, wherein, when the size of the recording material in the direction perpendicular to the transport direction of the recording material is smaller than a predetermined size, the first and second alignment toner images are formed on the belt member beside the first and second toner images on the recording material in the direction perpendicular to the transport direction of the recording material.

4. An image forming apparatus according to claim 3, wherein, when the size of the recording material in the direction perpendicular to the transport direction of the recording material is larger than the predetermined size, the first and second alignment toner images are formed between toner images to be formed on the recording material.

5. An image forming apparatus comprising:

a first image forming portion which forms a first toner image using a first color;

a second image forming portion which forms a second toner image using a second color different from the first color;

a belt member which bears a recording material;

a transfer part which transfers the first toner image formed by the first image forming portion and the second toner image formed by the second image forming portion onto the recording material on the belt member so as to superpose the second toner image on the first toner image;

a fixing apparatus which fixes the first and second toner images on the recording material using heat;

a detection part which detects a first alignment toner image formed on the belt member by the first image forming portion, and which detects a second alignment toner image formed on the belt member by the second image forming portion;

an adjusting part which adjusts an image forming condition of one of the first image forming portion and the second image forming portion due to the detecting of the first and second alignment toner images by the detection part; and a recording material detection portion which detects a size of the recording material at least in a direction perpendicular to a transport direction of the recording material; and a control portion which, in a continuous image forming job for continuously forming images on the recording material, increases a frequency of execution of the adjusting portion when the size of the recording material in the direction perpendicular to the transport direction of the recording material becomes smaller.

6. An image forming apparatus according to claim 5, wherein, the control portion causes the adjusting part to execute per a predetermined number of image formations, and the control portion decreases the number of image formations when the size of the recording material in the direction perpendicular to the transport direction of the recording material becomes smaller.

7. An image forming apparatus according to claim 5, wherein, when the size of the recording material in the direction perpendicular to the transport direction of the recording material is smaller than a predetermined size, the first and second alignment toner images are formed beside the first and second toner images on the recording material in the direction perpendicular to the transport direction of the recording material.

8. An image forming apparatus according to claim 7, wherein, when the size of the recording material in the direction perpendicular to the transport direction of the recording material is larger than the predetermined size, the first and second alignment toner images are formed between toner images to be formed on the recording material.

* * * * *